United States Patent [19]

Bauer

[11] 4,113,603

[45] Sep. 12, 1978

[54] TWO-STAGE HYDROTREATING OF PYROLYSIS GASOLINE TO REMOVE MERCAPTAN SULFUR AND DIENES

[75] Inventor: William V. Bauer, New York, N.Y.

[73] Assignee: The Lummus Company, Bloomfield, N.J.

[21] Appl. No.: 843,413

[22] Filed: Oct. 19, 1977

[51] Int. Cl.[2] ..... C10G 23/04

[52] U.S. Cl. ..... 208/89; 208/212; 208/255

[58] Field of Search ..... 208/89, 212, 210

[56] References Cited

U.S. PATENT DOCUMENTS

| | | | |
|---|---|---|---|
| 3,190,830 | 6/1965 | Rowland et al. | 208/89 |
| 3,222,274 | 12/1965 | Carl | 208/89 |
| 3,236,764 | 2/1966 | Den Herder et al. | 208/89 |
| 3,347,779 | 10/1967 | Groenendaal et al. | 208/89 |
| 3,369,998 | 2/1968 | Bercik et al. | 208/210 |
| 3,429,804 | 2/1969 | Sze et al. | 208/210 |
| 3,492,220 | 1/1970 | Lempert et al. | 208/210 |
| 3,494,859 | 2/1970 | Parker | 208/210 |
| 3,594,307 | 7/1971 | Kirk, Jr. | 208/210 |
| 3,882,049 | 5/1975 | Bertolacini et al. | 208/210 |
| 3,912,620 | 10/1975 | Gallagher | 208/210 |
| 3,915,841 | 10/1975 | Murphy, Jr. et al. | 208/210 |

*Primary Examiner*—George Crasanakis
*Attorney, Agent, or Firm*—Marn & Jangarathis

[57] ABSTRACT

A pyrolysis gasoline, containing dienes and mercaptan sulphur is hydrotreated in a first stage in the presence of a non-noble metal catalyst under conditions primarily designed to effect mercaptan sulphur reduction, rather than diene reduction, followed by hydrotreating in a second stage in the presence of a noble metal catalyst to effect the desired reduction in diene value. The two stage treatment results in a stable pyrolysis gasoline product free of excessive polymer requiring no re-distillation, with "doctor sweet" quality, with the treatment being effected at higher space velocities and lower temperatures than those normally employed.

14 Claims, 2 Drawing Figures

Figure 1:
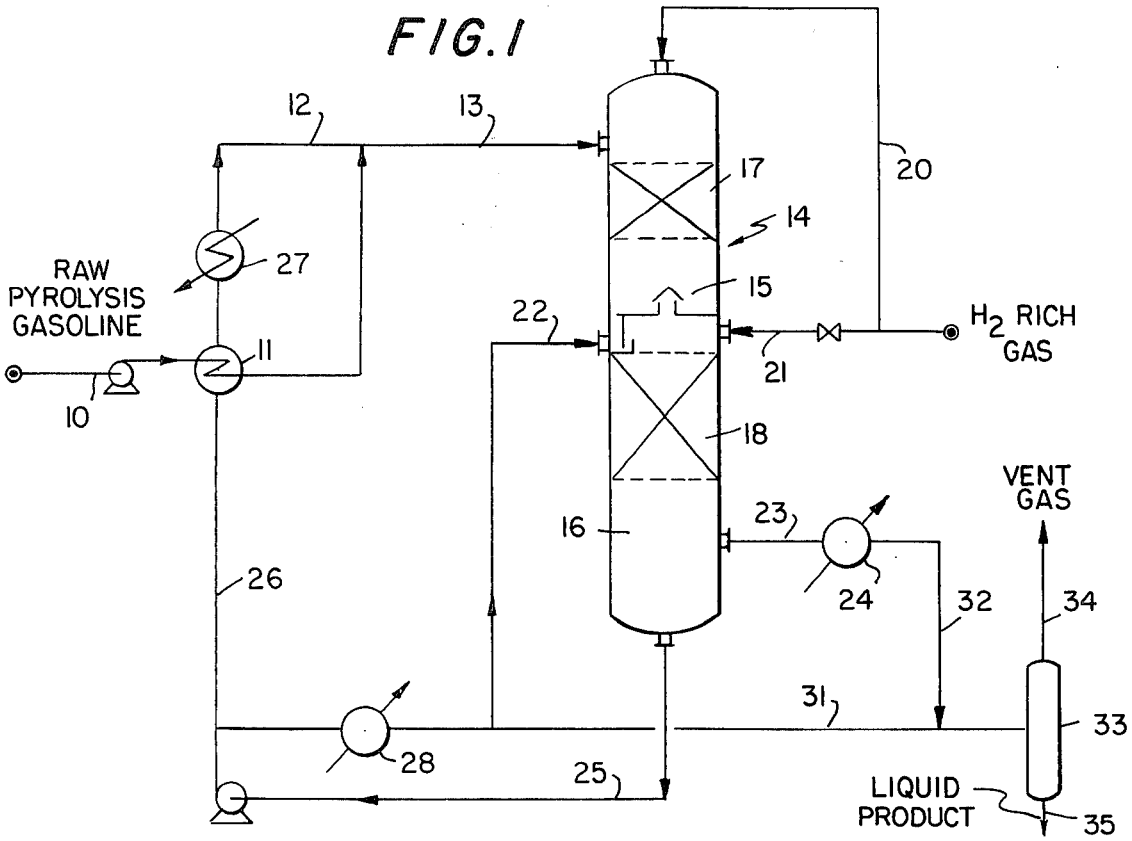

TWO-STAGE HYDROTREATING OF PYROLYSIS GASOLINE TO REMOVE MERCAPTAN SULFUR AND DIENES

This invention relates to the treatment of a liquid fraction, containing dienes and mercaptan sulphur, and more particularly, to a new and improved process for hydrotreating a pyrolysis gasoline to effect stabilization thereof.

The pyrolysis of hydrocarbons for olefin production generates byproduct liquids including components in the gasoline boiling range. These liquids have a high aromatic and olefinic content and excellent anti-knock characteristics, and are valuable as gasoline pool components or as a source of aromatics. However, pyrolysis liquids also contain high levels of reactive constituents, such as conjugated diolefins and styrenes, and are therefore very unstable and require hydrotreating before further processing or utilization.

In stabilizing pyrolysis gasolines by hydrotreating, there are used two general types of catalysts; non-noble metal catalysts and noble metal catalysts. Thus, for example, U.S. Pat. No. 3,691,066 describes a process for the hydrotreating of pyrolysis gasoline in the presence of a nickel catalyst to effect reduction in both diene and mercaptan sulphur values. The use of such a catalyst, however, promotes polymerization of reactive species, which requires redistillation of the product to meet specifications.

Noble metal catalysts have also been effectively employed for the hydrotreating of pyrolysis gasolines. However, current pyrolysis practice tends to utilize "heavier" petroleum fractions as pyrolysis feedstock, hence the sulphur levels in the pyrolysis products have been increasing. Using naphtha or heavier feedstocks, mercaptan sulphur levels in raw pyrolysis gasoline may be upwards of 15 or 25 ppm. It has been found that this level of mercaptan sulphur may be objectionable in meeting gasoline specifications and lowers the activity of noble metal catalysts.

An object of the present invention is to provide an improved process for treating liquid fractions containing dienes and mercaptan sulphur.

Another object of the present invention is to provide an improved process for hydrotreating pyrolysis gasoline.

A further object of the present invention is to provide a new and improved process for hydrotreating pyrolysis gasolines which have high sulphur contents.

These and other objects of the present invention should be more readily apparent from reading the following detailed description thereof.

In accordance with the present invention, there is provided a process for hydrotreating a liquid fraction, containing dienes and mercaptan sulphur, in particular, a pyrolysis gasoline or dripolene (such terms are interchangeably used in the art) wherein the hydrotreating is effected in two stages, with the hydrotreating in the first stage being effected in the presence of a non-noble metal catalyst at conditions selected to primarily reduce the mercaptan sulphur content of the pyrolysis gasoline, and the hydrotreating in the second stage being effected in the presence of a noble metal catalyst at conditions selected to reduce the diene value of the pyrolysis gasoline. Applicant has found that by effecting treatment in the first stage in the presence of a non-noble metal catalyst at conditions primarily selected to effect a reduction in mercaptan sulphur, rather than a reduction in diene value (although there is a reduction in diene values; however, such reduction is lower than normally effected), there is a reduction in reactor size and the rate of polymerization is reduced avoiding the formation of a "tail" in the ASTM distillation test, which would require re-distillation of the product to adjust its "end point". Furthermore, the reduction in mercaptan sulphur levels of the first stage product permits the use of higher space velocity and/or lower temperatures for the second noble metal hydrotreating stage for diene value reduction.

The use of two hydrotreating stages in accordance with the invention permits production of stable pyrolysis gasoline free of excessive "tail", requiring no re-distillation, with "doctor sweet" quality, using higher space velocities and/or lower temperatures than would be possible when utilizing a single catalyst.

The non-noble metal hydrotreating catalyst employed in the first stage can be either nickel alone, tungsten alone, a combination of tungsten and nickel, or a combination of nickel and/or tungsten, with cobalt and/or molybdenum. Thus, for example, the catalyst may be a cobalt-tungsten catalyst, a cobalt-molybdenum-tungsten catalyst, a tungsten catalyst or a nickel catalyst, with such catalyst being used in either the pre-reduced or in the pre-sulfided form or condition. A particularly preferred catalyst is a cobalt-tungsten catalyst supported on a high surface area alumina (surface area of greater than 50 meters square per gram). Such a preferred catalyst generally contains from about 0.4 percent to about 15 percent, preferably from about 1 percent to about 5 percent of cobalt, (by weight) and from about 1 percent to about 20 percent, preferably from about 3 percent to about 10 percent of tungsten (by weight), with the cobalt to tungsten weight ratio generally being in the order of from about 0.2 to about 1.0, preferably from about 0.25 to about 0.75.

The first stage hydrotreating, as hereinabove described, is primarily effected for reducing the mercaptan sulphur content of the pyrolysis gasoline. As a result, the conditions are selected in a manner such that there is an effective reduction of mercaptan sulphur values, without the formation of polymers, which would result in the final product having a "tail." As a result, the hydrotreating of the pyrolysis gasoline in the presence of the non-noble metal catalyst is generally effected at higher space velocities and/or lower temperatures than those which would be normally employed for effecting hydrotreating in the presence of a non-noble metal catalyst. As a result, the partially hydrotreated product from the first stage has a diene value higher than the diene value of the hydrotreated products normally treated in the presence of a non-noble metal catalyst.

The hydrotreating in the first stage is generally effected at an inlet temperature of from about 120° F to about 400° F, preferably from about 180° F to about 320° F, and at space velocities in the order of from about 2 to about 15, preferably from about 3 to 9, V/H/V. The hydrotreating pressures may be in the order of from about atmospheric pressure to about 1000 psig, with the preferred pressures being in the order of from 250 to about 500 psig. The partially hydrotreated product produced in the first hydrotreating stage has a mercaptan sulphur content of no greater than about 10 ppm, with the mercaptan sulphur content generally being in the order of from about 0.1 to about 10 ppm, and most generally in the order of from about 1 to 5 ppm. In addition, the partially hydrotreated product from the first hydrotreating stage generally has a diene value in excess of two, and most generally in excess of 4.

The partially hydrotreated product from the first hydrotreating stage is then hydrotreated in a second stage in the presence of a noble metal catalyst supported on a suitable support, with the catalyst preferably being palladium with or without modifiers, supported on alumina. The second stage hydrotreating is effected at conditions to provide a hydrotreated product having a reduced diene value, and the conditions are controlled to provide a hydrotreated product having the desired diene value. In accordance with the present invention, such second stage hydrotreating in the presence of a noble metal catalyst may be effected at higher space velocities and/or lower temperatures than those generally employed for effecting hydrotreating in the presence of a noble metal catalyst. In general, the second stage hydrotreating is effected at a temperature of from about 120° F to about 450° F, and preferably from about 140° F to about 400° F, and at space velocities of from 2 to 10, and preferably from 4 to 8 V/H/V. In general, the pressure is in the order of from about 150 to about 1000 psig, and preferably from about 250 to about 500 psig. The hydrotreated product from the second stage has a diene value of no greater than 3, generally in the order of from about 1 to 3, and most generally in the order of from about 1.5 to about 2.5.

The pyrolysis gasoline or dripolene feeds treated in accordance with the present invention are well known in the art. As known in the art, such feeds are unstable liquids boiling in the gasoline range which are produced, as byproducts, in hydrocarbon cracking or pyrolysis processes. Pyrolysis gasoline generally boils within the range of from 50° to 400° F and includes olefins (di-olefins and mono-olefins), aromatic constituents, together with mercaptan sulphur. Such pyrolysis gasolines generally have a diene value of from 20 to 100, and most usually from 25 to 75. In addition, such pyrolysis gasolines have a mercaptan sulphur content in the order of from about 5 to 300 ppm, and most generally in the order of from about 10 to about 50 ppm.

Figure 2:
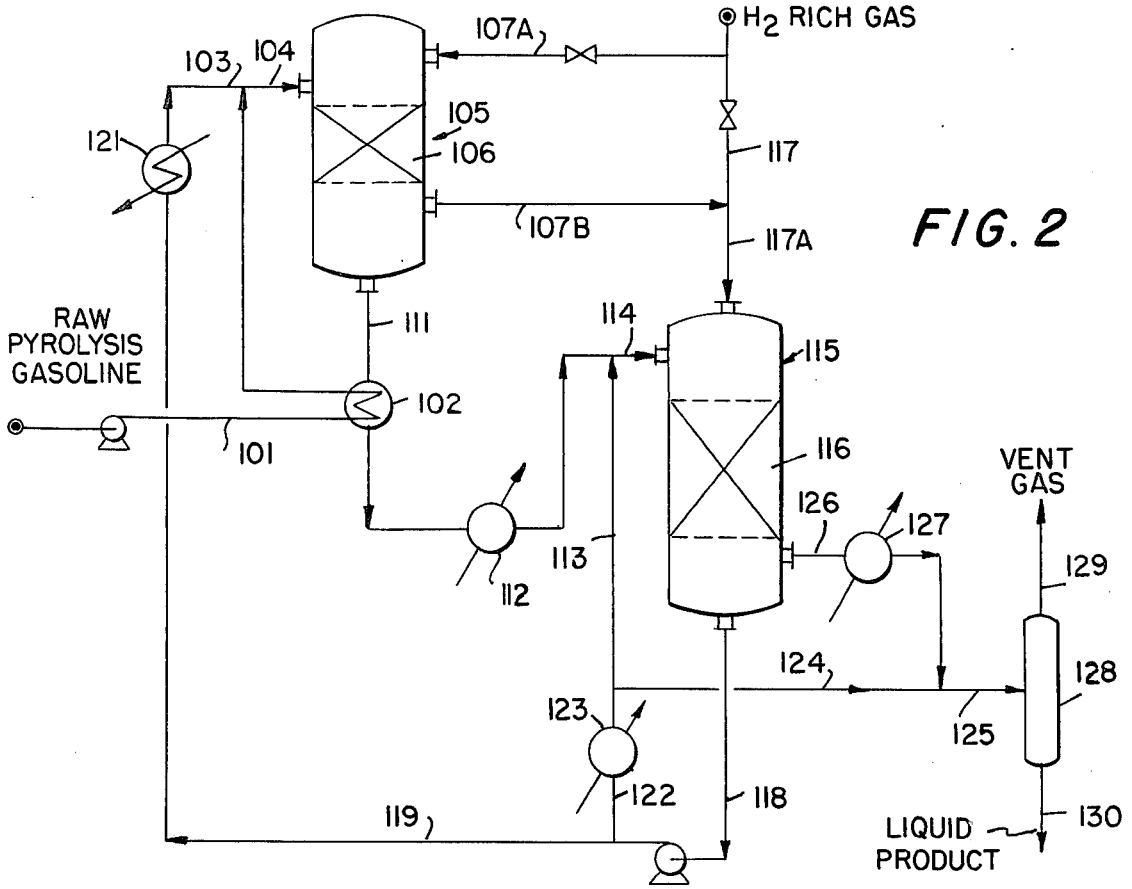

The invention will be further described with respect to embodiments thereof illustrated in the accompanying drawings, wherein:

FIG. 1 is a simplified schematic representation of an embodiment of the present invention wherein the two reaction stages are included in a single reactor; and FIG. 2 is a simplified schematic representation of an embodiment of the present invention wherein the two reaction stages are included in two separate reactors.

Referring now to FIG. 1 of the drawings, a pyrolysis gasoline feed in line 10 has the temperature thereof adjusted in a heat exchanger 11 and is then combined with recycle, obtained as hereinafter described in line 12. The combined pyrolysis gasoline and recycle in line 13 are introduced into a hydrotreating reactor schematically generally indicated as 14. The reactor 14 is divided into 2 reaction stages 15 and 16, with reaction stage 15 including a non-noble metal catalyst schematically represented as 17 and reaction stage 16 including a noble metal catalyst schematically represented as 18. The reaction stages 15 and 16 are further provided with a hydrogen gas introduced through lines 20 and 21.

In reaction stage 15, the pyrolysis gasoline is hydrotreated in the presence of the non-noble metal catalyst at the conditions hereinabove described to primarily effect a reduction in the mercaptan sulphur content of the pyrolysis gasoline. The partially hydrotreated pyrolysis gasoline in the bottom of reaction stage 15 is combined with recycle product in line 22, obtained as hereinafter described and the combined recycle and partially hydrotreated pyrolysis gasoline introduced into the second stage 16 wherein hydrotreating is effected, as hereinabove described, in the presence of the noble metal catalyst, to effect a reduction in the diene value.

A gaseous product is withdrawn from the second reaction stage 16 through line 23, including a cooler 24, wherein the gas is cooled to effect condensation of remaining liquid product. A hydrotreated liquid product is withdrawn from reaction stage 16 through line 25, and a first portion thereof in line 26 is passed through heat exchanger 11 and heat exchanger 27 for combination with the pyrolysis gasoline feed. The remaining portion of the hydrotreated product has its temperature adjusted in heated exchanger 28, with a portion thereof being passed through line 22 for combination with the partially hydrotreated product from first reaction stage 15. The remainder of the hydrotreated product in line 31 is combined with the product withdrawn from heat exchanger 23, in line 32, and the combined product introduced into a vaporliquid separator 33. A vent gas is withdrawn from separator 33 in line 34, and hydrotreated liquid product is withdrawn from separator 33 in line 34, and hydrotreated liquid product is withdrawn from separator 33 through line 35. The hydrotreated product in line 35 is a stable pyrolysis gasoline free of excessive "tail," requiring no distillation, with "doctor sweet" quality.

Referring now to FIG. 2 of the drawings, a pyrolysis gasoline feed in line 101 has its temperature adjusted in heat exchanger 102 and combined with recycle product in line 103, obtained as hereinafter described. The combined pyrolysis gasoline feed and recycle product in line 104 is introduced into the first hydrotreating stage in a reactor schematically indicated as 105. Reactor 105 contains a non-noble metal catalyst, schematically indicated as 106. The first hydrotreating stage is further provided with a hydrogen containing gas through line 107A. The hydrotreating reactor 105 is operated at the conditions hereinabove described to primarily effect a reduction in the mercaptan sulphur content of the pyrolysis gasoline.

A partially hydrotreated pyrolysis gasoline is withdrawn from reactor 105 through line 111, and the temperature thereof is adjusted in heat exchangers 102 and 112, with the partially hydrotreated pyrolysis gasoline being combined with hydrotreated product in line 113, obtained as hereinafter described. A hydrogen containing gaseous effluent is withdrawn through line 107B, and combined with fresh feed hydrogen in line 117.

A combined feed in line 114 is introduced into a second reactor, generally indicated as 115, containing a bed 116 of noble metal catalyst; in particular, supported palladium. A hydrogen rich gas is also provided to reactor 115 through line 117A. Reactor 115 is operated, as hereinabove described to complete the hydrotreating of the pyrolysis gasoline by reducing the diene value thereof.

Liquid hydrotreated product is withdrawn from reactor 115 through line 118 and a portion thereof is passed through line 119, including a heat exchanger 121 for adjusting the temperature thereof, for recycle to the first hydrotreating reactor 105, as hereinabove described. The remaining portion of the liquid hydrotreated pyrolysis gasoline is passed through line 122 including a heat exchanger 123, with a first portion thereof being passed through line 113 for recycle to the second stage hydrotreating reactor 115.

A gaseous effluent is withdrawn from reactor 115 through line 126, including a cooler 127 for cooling the gaseous effluent to condense a portion thereof, and combined with the remaining portion of the liquid product in line 124. The combined product in line 125 is introduced into a separator 128, with a vent gas being withdrawn through line 129, and the hydrotreated pyrolysis gasoline liquid product being recovered through line 130.

The invention will be further described with respect to the following example; however, the scope of the invention is not to be limited thereby.

EXAMPLE

Pyrolysis gasoline having a diene value of 60 and a mercaptan sulphur content of 50 parts per million is introduced at a rate of 8000 barrels per day into a first stage hydrotreating reactor, containing a tungsten-nickel sulphide catalyst supported on alumina. Hydrogen gas is also introduced into the first stage hydrotreating reactor at a rate of 35,000 SCF/HR. The rate of hydrogen flow can vary widely from 17,000 to 133,000 SCF/HR, depending upon the diolefin saturation reaction rate. The first stage hydrotreating reactor is operated at a pressure of 400 psig, an average temperature of 230° F and a liquid hourly space velocity of 8.08. A combined liquid and gaseous product is withdrawn from the first stage hydrotreating reactor, and the liquid product has a diene value of 45 and a mercaptan sulphur content of 1.6 parts per million.

The combined liquid and gaseous effluents from the first stage hydrotreater are introduced into a second stage hydrotreater, containing a palladium supported on alumina catalyst. The second hydrotreater is operated at a pressure of 400 psig, an average temperature of 175° F and a liquid hourly space velocity of 4.9.

The liquid product from the second stage hydrotreater has a mercaptan sulphur content of 1.6 parts per million and a diene value of 2.0. In addition, the ASTM boiling curve, has a negligible tail, which indicates that there is little, if any, polymer formation.

Numerous modifications and variations of the present invention are possible in light of the above teachings and, therefore, within the scope of the appended claims, the invention may be practiced otherwise than as particularly described.

I claim:

1. A process for hydrotreating a liquid petroleum fraction, containing dienes and mercaptan sulphur, comprising:

hydrotreating said liquid fraction, containing dienes and mercaptan sulphur, in a first stage in the presence of a non-noble metal catalyst to reduce the mercaptan sulphur content thereof; and hydrotreating hydrotreated product from the first stage in a second stage in the presence of a noble metal catalyst to reduce the diene value.

2. The process of claim 1 wherein product from the first stage has a mercaptan sulphur content of no greater than 10 ppm.

3. The process of claim 2 wherein product from the first stage has a diene value in excess of 2.

4. The process of claim 3 wherein product from the first stage has a diene value in excess of 4.

5. The process of claim 4 wherein the liquid fraction is a pyrolysis gasoline.

6. The process of claim 4 wherein the first stage hydrotreating is effected at a temperature of from 120° F to 400° F, and at a space velocity of from 2 to about 15, V/H/V.

7. The process of claim 6 wherein hydrotreated product from the second stage has a diene value of no greater than 3.

8. The process of claim 7 wherein the second stage hydrotreating is effected at a temperature of from 120° F to 450° F, and at a space velocity of from 2 to 10 V/H/V.

9. The process of claim 8 wherein the hydrotreating in two stages is effected in a single reactor.

10. The process of claim 8 wherein the hydrotreating in two stages is effected in two separate reactors.

11. The process of claim 8 wherein the first stage catalyst is selected from the group consisting of nickel, tungsten and a combination of at least one member selected from the group consisting of nickel and tungsten with at least one member selected from the group consisting of cobalt and molybdenum.

12. The process of claim 11 wherein the second stage catalyst is palladium.

13. The process of claim 12 wherein said liquid fraction is pyrolysis gasoline.

14. The process of claim 13 wherein the first stage hydrotreating is effected at a temperature of from 180° F to 320° F and at a space velocity of from 3 to 9 V/H/V and the second stage hydrotreating is effected at a temperature of from 140° F to400° F and a space velocity of from 4 to 8 V/H/V.

* * * * *